US011043763B2

(12) United States Patent
Jin

(10) Patent No.: US 11,043,763 B2
(45) Date of Patent: Jun. 22, 2021

(54) ELECTRICAL CONNECTOR AND ELECTRICAL CONNECTOR ASSEMBLY FOR CONNECTION TO A CIRCUIT BOARD WITH ZERO INSERTION FORCE

(71) Applicant: LOTES CO., LTD, Keelung (TW)

(72) Inventor: Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/867,792

(22) Filed: May 6, 2020

(65) Prior Publication Data

US 2020/0358214 A1 Nov. 12, 2020

(30) Foreign Application Priority Data

May 7, 2019 (CN) ..... 201910373636.3

(51) Int. Cl.
*H01R 12/71* (2011.01)
*H01R 12/58* (2011.01)
(Continued)

(52) U.S. Cl.
CPC ..... *H01R 12/716* (2013.01); *H01R 12/58* (2013.01); *H01R 12/596* (2013.01);
(Continued)

(58) Field of Classification Search
CPC .... H01R 12/716; H01R 12/58; H01R 12/596; H01R 12/675; H01R 12/707; H01R 4/02; H01R 13/6581; H01R 13/111; H01R 12/73; H01R 13/10; H01R 12/7076; H01R 12/51; H01R 24/00; H01R 12/714; H01R 12/52; H01R 12/585; H01R 2107/00;
(Continued)

(56) References Cited

U.S. PATENT DOCUMENTS 8,033,877 B2 10/2011 Di Stefano

FOREIGN PATENT DOCUMENTS

CN 201075553 Y 6/2008
CN 201142406 Y 10/2008
(Continued)

*Primary Examiner* — Abdullah A Riyami
*Assistant Examiner* — Justin M Kratt
(74) *Attorney, Agent, or Firm* — Locke Lord LLP; Tim Tingkang Xia, Esq.

(57) ABSTRACT

An electrical connector and an electrical connector assembly are provided. The electrical connector assembly includes: a mating assembly including a support plate and multiple insertion portions provided on the support plate and protruding downward out of the support plate; and an electrical connector. The electrical connector includes: a substrate, provided with multiple accommodating holes running through the substrate vertically; and multiple terminals accommodated in the accommodating holes. Each terminal has a base and two clamping portions configured to clamp a corresponding insertion portion. The two clamping portions are located in front of the base. A top end of the base is lower than top ends of the two clamping portions. When the two clamping portions jointly clamp the corresponding insertion portion, a portion of the corresponding insertion portion lower than the top ends of the clamping portions is located right above the base of an adjacent terminal.

16 Claims, 15 Drawing Sheets

(51) Int. Cl.

| | |
|---|---|
| ***H01R 12/59*** | (2011.01) |
| ***H01R 12/67*** | (2011.01) |
| ***H01R 12/70*** | (2011.01) |
| *H01R 12/52* | (2011.01) |
| *H01R 24/00* | (2011.01) |
| *H01R 43/20* | (2006.01) |
| *H01R 107/00* | (2006.01) |
| *H01R 12/00* | (2006.01) |
| *H01R 13/24* | (2006.01) |
| *H01R 13/11* | (2006.01) |
| *H01R 12/73* | (2011.01) |
| *H01R 4/02* | (2006.01) |
| *H01R 12/51* | (2011.01) |
| *H01R 13/6581* | (2011.01) |
| *H01R 13/10* | (2006.01) |
| *H01R 4/28* | (2006.01) |

(52) U.S. Cl.
CPC ..... *H01R 12/675* (2013.01); *H01R 12/707* (2013.01); *H01R 4/02* (2013.01); *H01R 4/28* (2013.01); *H01R 12/00* (2013.01); *H01R 12/51* (2013.01); *H01R 12/52* (2013.01); *H01R 12/585* (2013.01); *H01R 12/7076* (2013.01); *H01R 12/71* (2013.01); *H01R 12/712* (2013.01); *H01R 12/714* (2013.01); *H01R 12/73* (2013.01); *H01R 13/10* (2013.01); *H01R 13/111* (2013.01); *H01R 13/2457* (2013.01); *H01R 13/2485* (2013.01); *H01R 13/6581* (2013.01); *H01R 24/00* (2013.01); *H01R 43/205* (2013.01); *H01R 2107/00* (2013.01)

(58) Field of Classification Search
CPC .. H01R 43/205; H01R 12/00; H01R 13/2457; H01R 13/2485; H01R 12/712; H01R 12/71; H01R 4/28
USPC ..... 439/66
See application file for complete search history.

(56) References Cited

FOREIGN PATENT DOCUMENTS

| | | | | |
|---|---|---|---|---|
| CN | 201167199 | Y | | 12/2008 |
| CN | 201197042 | Y | * | 2/2009 |
| CN | 201197042 | Y | | 2/2009 |
| CN | 201450142 | U | | 5/2010 |
| CN | 101420078 | B | | 9/2012 |
| CN | 203690613 | U | | 7/2014 |
| CN | 108832335 | A | | 11/2018 |

* cited by examiner

A-A

C–C

ELECTRICAL CONNECTOR AND ELECTRICAL CONNECTOR ASSEMBLY FOR CONNECTION TO A CIRCUIT BOARD WITH ZERO INSERTION FORCE

CROSS-REFERENCE TO RELATED PATENT APPLICATION

This non-provisional application claims priority to and the benefit of, pursuant to 35 U.S.C. § 119(a), patent application Serial No. CN201910373636.3 filed in China on May 7, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and an electrical connector assembly, and particularly to an electrical connector and an electrical connector assembly having zero insertion force.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent No. CN200720193759.1 discloses an electrical connector with zero insertion force. The electrical connector is configured to electrically connect an electronic assembly to a circuit board. The electronic assembly includes a plurality of pins. The electrical connector includes a seat and a plurality of electrical connector terminals. The seat has a plurality of terminal holes running therethrough, and each electrical connector terminal is correspondingly accommodated in each terminal hole. Each electrical connector terminal has a base. Two elastic arms bend upward and extend from a left side and a right side of the base. A space between the two elastic arms forms a zero insertion force type insertion space in a vertical direction downward from top thereof. The upper ends of the two elastic arms respectively form two guide portions and two contact portions relative to the insertion space. The two guide portions extend horizontally outward, and extend obliquely to approach each other. The two contact portions are respectively connected to the extending tail ends of the two guide portions, and extend horizontally and toward a direction away from the insertion space. A clamping space is formed between the two contact portions to clamp a corresponding pin. Each of the pins is placed in the insertion space downward from top thereof with a zero insertion force, and is guided by the two guide portions into the clamping space.

However, after the corresponding pin enter the clamping space, each pin maintains a certain distance from the base of an adjacent front electrical connector terminal along a front-rear direction, such that a distance between the two adjacent electrical connector terminals in the front-rear direction is large, which is not consistent with a development trend of dense arrangement of the electrical connector terminals.

Therefore, a heretofore unaddressed need to design an electrical connector and an electrical connector assembly exists in the art to address the aforementioned deficiencies and inadequacies.

SUMMARY

The present invention is directed to an electrical connector and an electrical connector assembly having a denser terminal arrangement.

To achieve the foregoing objective, an electrical connector according to certain embodiments of the present invention adopts the following technical solutions.

An electrical connector is configured to be electrically connected to a mating component having a plurality of insertion portions. The electrical connector includes: a substrate, provided with a plurality of accommodating holes running through the substrate vertically; and a plurality of terminals, correspondingly accommodated in the accommodating holes, wherein each of the terminals has a base, two connecting portions formed by extending upward from the base, two guide portions and two clamping portions, a gap between the two guide portions is greater than a gap between the two clamping portions, the guide portions are respectively connected to the connecting portions, the clamping portions are respectively formed by extending forward from the guide portions, the two clamping portions are configured to clamp a corresponding insertion portion of the insertion portions, wherein after the corresponding insertion portion is inserted downward between the two guide portions, the guide portions guide the corresponding insertion portion to move forward to the clamping portions, a top end of the base is lower than top ends of the clamping portions, an accommodating space is formed right above the base and located behind the guide portions, a height of the accommodating space is between the top ends of the clamping portions and the top end of the base, and when the corresponding insertion portion is jointly clamped by the two clamping portions, a portion of the corresponding insertion portion lower than the top ends of the clamping portions partially protrudes forward from the clamping portions and is accommodated in the accommodating space of an adjacent front terminal.

In certain embodiments, the substrate is a circuit board, the base extends downward to form at least one fixing portion fixed to the accommodating hole, at least one leading portion is formed by extending obliquely downward from the fixing portion and protrudes out of the accommodating hole to be soldered to a main circuit board, the base is located outside the substrate, and a front end of each of the clamping portions passes forward beyond the fixing portion.

In certain embodiments, two fixing portions are provided, a first through slot is formed between front sides of the two fixing portions, and a second through slot is formed between rear sides of the two fixing portions.

In certain embodiments, two leading portions are provided separately, a first opening is formed between front sides of the two leading portions, and a second opening is formed between rear sides of the two leading portions.

In certain embodiments, the terminals further comprise a plurality of ground terminals, a lower surface of the substrate has a shielding layer, an inner wall of each of the accommodating holes is insulating, each of the ground terminals is soldered to a main circuit board by a solder, and the solder connects each of the ground terminals and the shielding layer.

In certain embodiments, each of the insertion portions is ball-shaped, a distance between the two clamping portions of each of the terminals gradually decreases upward from a bottom thereof, and a position where the two clamping portions clamp the corresponding insertion portion is higher than a virtual horizontal center line of the corresponding insertion portion.

Compared with the related art, the electrical connector according to certain embodiments of the present invention has the following beneficial effects:

By providing a portion of the corresponding insertion portion lower than the top ends of the clamping portions to protrude forward from the clamping portions and to be accommodated in the accommodating space of an adjacent front terminal, the corresponding insertion portion and an adjacent front terminal may overlap in the vertical direction without the need to keep a distance therebetween in the front-rear direction, thus shortening a distance between the adjacent terminals in the front-rear direction, and making the arrangement of the terminals denser.

To achieve the foregoing objective, an electrical connector assembly according to certain embodiments of the present invention adopts the following technical solutions.

An electrical connector assembly includes: a mating component, comprising a support plate and a plurality of insertion portions provided on the support plate and protruding downward out of the support plate; and an electrical connector, configured for the insertion portions to insert downward therein, wherein the electrical connector comprises: a substrate, provided with a plurality of accommodating holes running through the substrate vertically; and a plurality of terminals, accommodated in the accommodating holes, wherein each of the terminals has a base and two clamping portions configured to clamp a corresponding insertion portion of the insertion portions, the two clamping portions are located in front of the base, a top end of the base is lower than top ends of the two clamping portions, and when the corresponding insertion portion is jointly clamped by the two clamping portions, a portion of the corresponding insertion portion lower than the top ends of the clamping portions is located right above the base of an adjacent terminal.

In certain embodiments, two connecting portions extend upward from the base, two guide portions are respectively formed by extending backward from the two clamping portions to guide the insertion portions to move forward, a distance between the two clamping portions is less than a distance between the two guide portions, the guide portions are connected to the connecting portions, and a front end of each of the clamping portions passes forward beyond the connecting portions.

In certain embodiments, each of the insertion portions is ball-shaped and is made of copper.

In certain embodiments, the distance between two clamping portions of each of the terminals gradually decreases upward from a bottom thereof, and a position where the two clamping portions clamp the corresponding insertion portion is higher than a virtual horizontal center line of the corresponding insertion portion.

In certain embodiments, an upper surface of the support plate has a plurality of soldering regions to be correspondingly soldered with a plurality of conductors of a chip module, and a distance between two adjacent ones of the insertion portions is greater than a distance between two adjacent ones of the conductors.

In certain embodiments, the substrate is a circuit board, the base extends downward to form at least one fixing portion fixed to the accommodating hole, at least one leading portion is formed by extending obliquely downward from the fixing portion and protrudes out of the accommodating hole to be soldered to a main circuit board, the base is located outside the substrate, and a front end of each of the clamping portions passes forward beyond the fixing portion.

In certain embodiments, two fixing portions are provided, a first opening is formed between front sides of the two fixing portions, and a second opening is formed between rear sides of the two fixing portions.

In certain embodiments, two leading portions are provided separately, a first opening is formed between front sides of the two leading portions, and a second opening is formed between rear sides of the two leading portions.

In certain embodiments, the terminals further comprise a plurality of ground terminals, each of an upper surface of the substrate and a lower surface of the support plate respectively has a shielding layer, and each of the ground terminals is electrically connected to the shielding layers.

In certain embodiments, the support plate is provided with a stopped portion, a stopping portion is located in front of the stopped portion, and the stopping portion stops the stopped portion forward.

Compared with the related art, the electrical connector assembly according to certain embodiments of the present invention has the following beneficial effects:

By providing a portion of the corresponding insertion portion lower than the top ends of the clamping portions to be located right above the base of an adjacent terminal, the corresponding insertion portion and an adjacent front terminal may overlap in the vertical direction without the need to keep a distance therebetween in the front-rear direction, thus shortening a distance between the adjacent terminals in the front-rear direction, and making the arrangement of the terminals denser.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
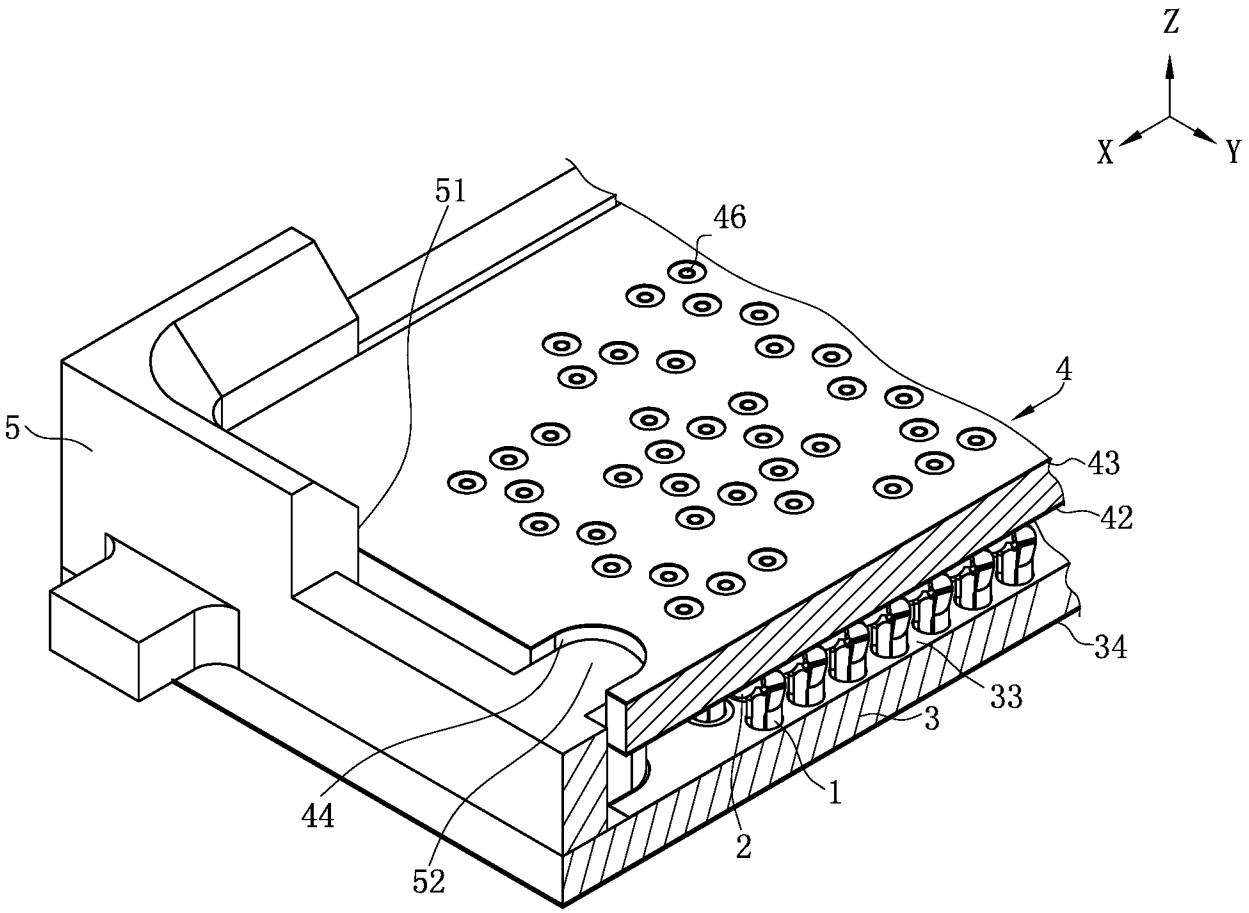
FIG. 1 is a perspective view of an electrical connector assembly according to certain embodiments of the present invention when an insertion portion thereof moves to clamping portions.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-15. In accordance with the purposes of this invention, as embodied and broadly described herein, this invention, in one aspect, relates to an electrical connector and an electrical connector assembly.

As shown in FIGS. 1 to 15, a front-rear direction is defined as an X-axis, and the arrow of the X-axis points toward the front direction. A left-right direction is defined as a Y-axis, and the arrow of the Y-axis points toward the left direction. A vertical direction is defined as a Z-axis, and the arrow of the Z-axis points toward the upper direction.

FIGS. 1 to 15 show an electrical connector assembly according to certain embodiments of the present invention, which is configured to electrically connect a chip module 500 to a main circuit board 800, and includes a mating component 400 and an electrical connector 300. The mating component 400 includes a support plate 4 and a plurality of insertion portions 2 provided on the support plate 4 and protruding downward out of a lower surface of the support plate 4. The insertion portions 2 are ball-shaped and are made of copper. In another embodiment, the insertion portions 2 may also be slender cylinder-shaped, flat plate shaped, or of other shapes. The chip module 500 is supported on an upper surface of the support plate 4, and the chip module 500 and the support plate 4 are electrically connected to each other. The electrical connector 300 is located on the main circuit board 800, and includes a substrate 3 and a plurality of terminals 1 accommodated in the substrate 3.

Figure 2:
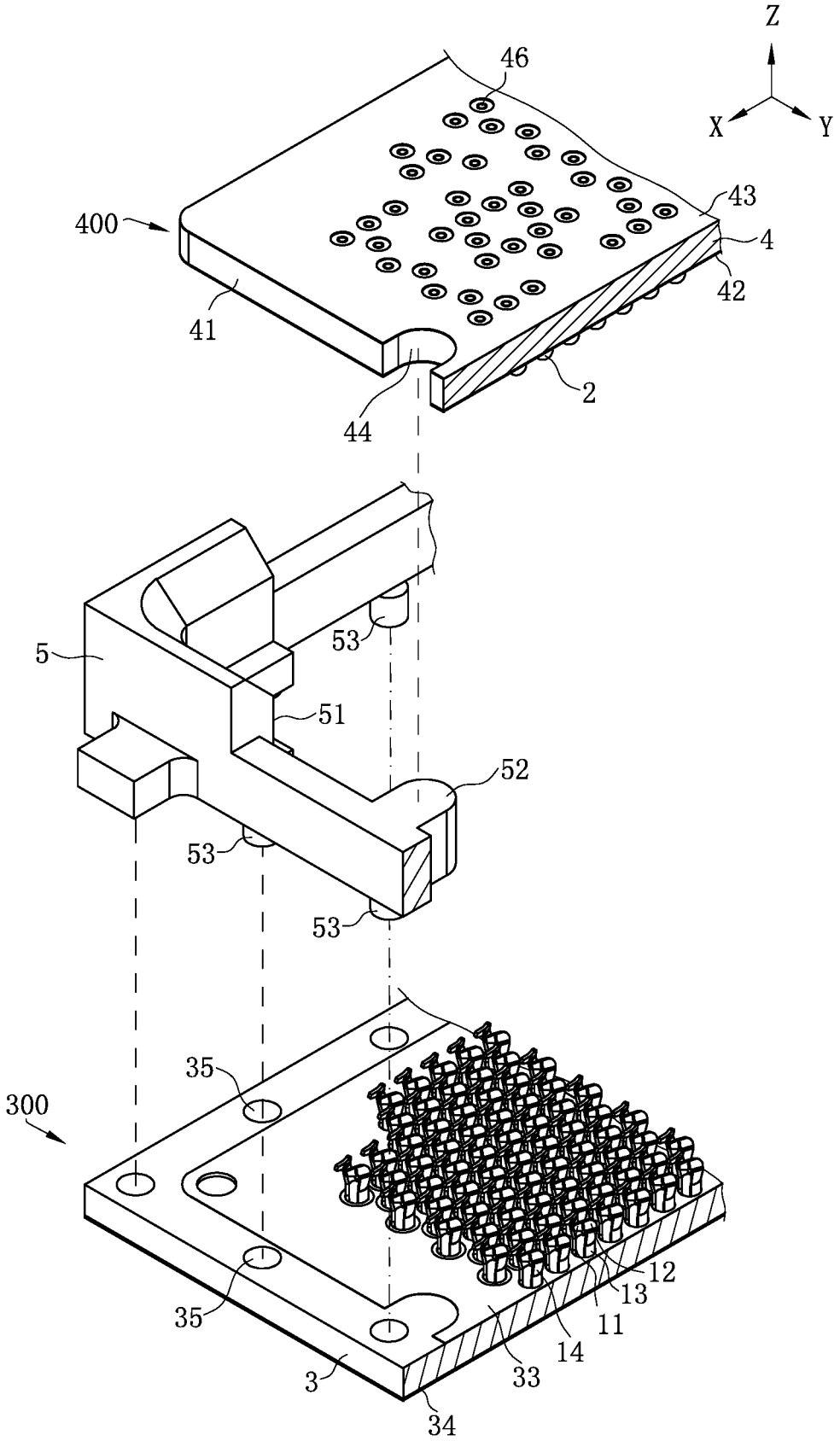
FIG. 2 is an exploded view of FIG. 1.
Figure 7:
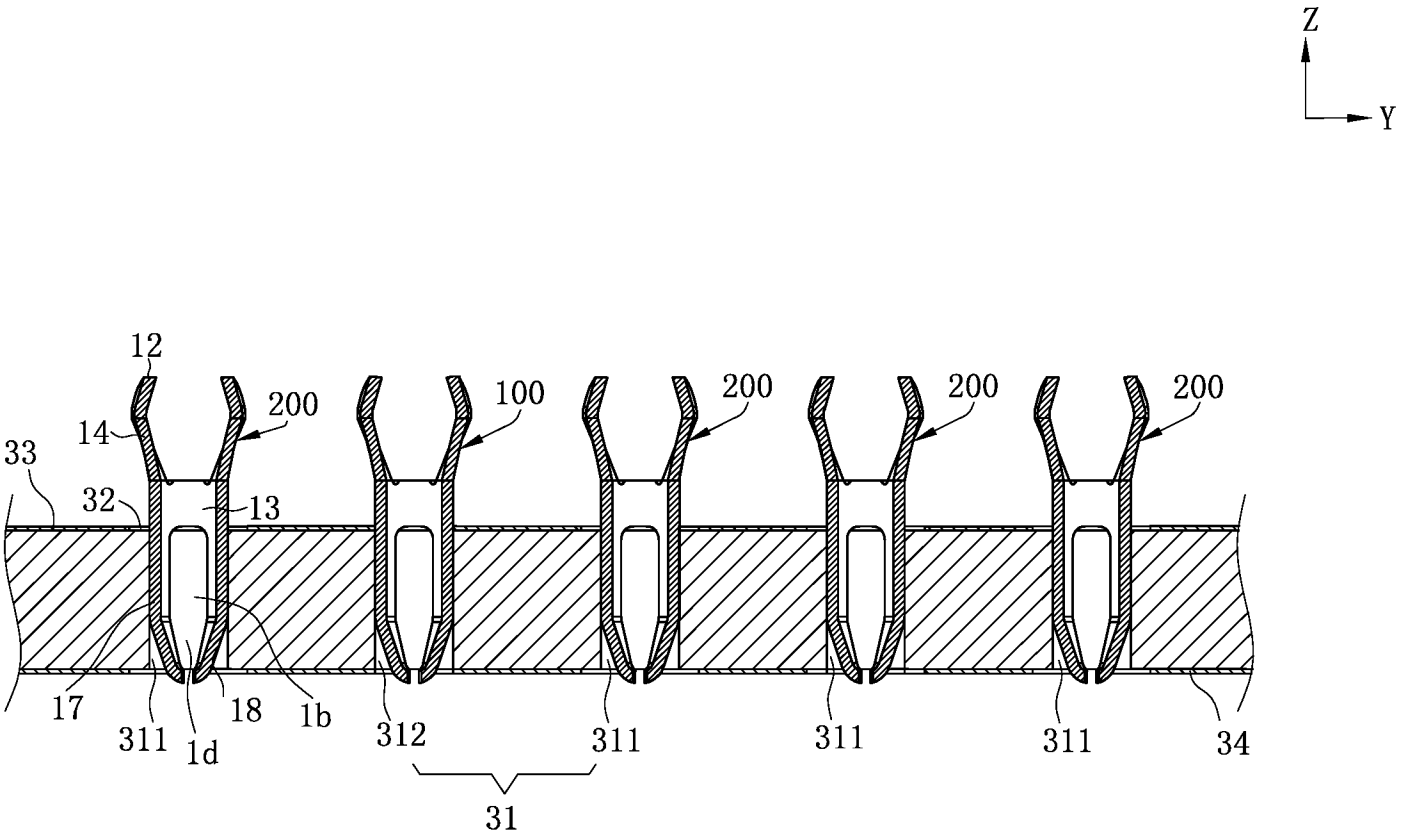
FIG. 7 is a sectional view of FIG. 5 along the B-B direction.
Figure 8:
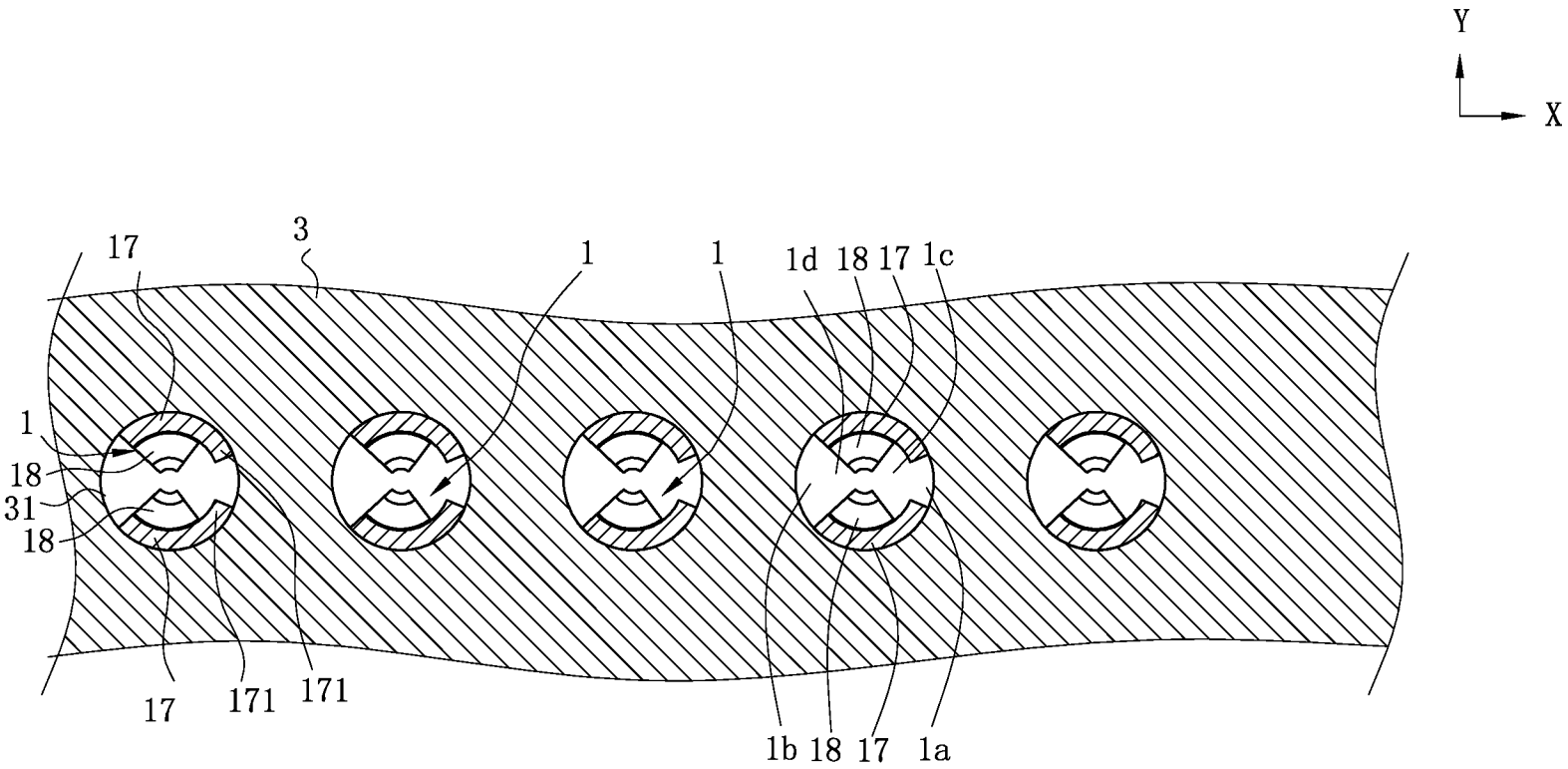
FIG. 8 is a sectional view of FIG. 3 along the C-C direction.

As shown in FIG. 1, FIG. 2, and FIG. 8, the substrate 3 is a circuit board (which is not limited thereto in other embodiments). A plurality of accommodating holes 31 run through the substrate 3 downward from top thereof. The inner walls of the accommodating holes 31 do not have conductive layers. That is, the inner walls of the accommodating holes 31 are insulating. Cross-sections of the accommodating holes 31 are circular. As shown in FIG. 7, the accommodating holes 31 include a plurality of first accommodating holes 311 and a plurality of second accommodating holes 312. A third shielding layer 33 is plated on an upper surface of the substrate 3, and the third shielding layer 33 covers upper edges of the second accommodating holes 312. The upper surface of the substrate 3 has a plurality of insulating regions 32, and each of the insulating regions 32 is provided around a corresponding one of the first accommodating holes 311 and located between the corresponding one of the first accommodating holes 311 and the third shielding layer 33, such that the first accommodating holes 311 are separated from the third shielding layer 33. A lower surface the substrate 3 has a fourth shielding layer 34. The fourth shielding layer 34 covers lower edges of the second accommodating holes 312, and there are intervals between the fourth shielding layer 34 and each of lower edges of the first accommodating holes 311.

Figure 3:
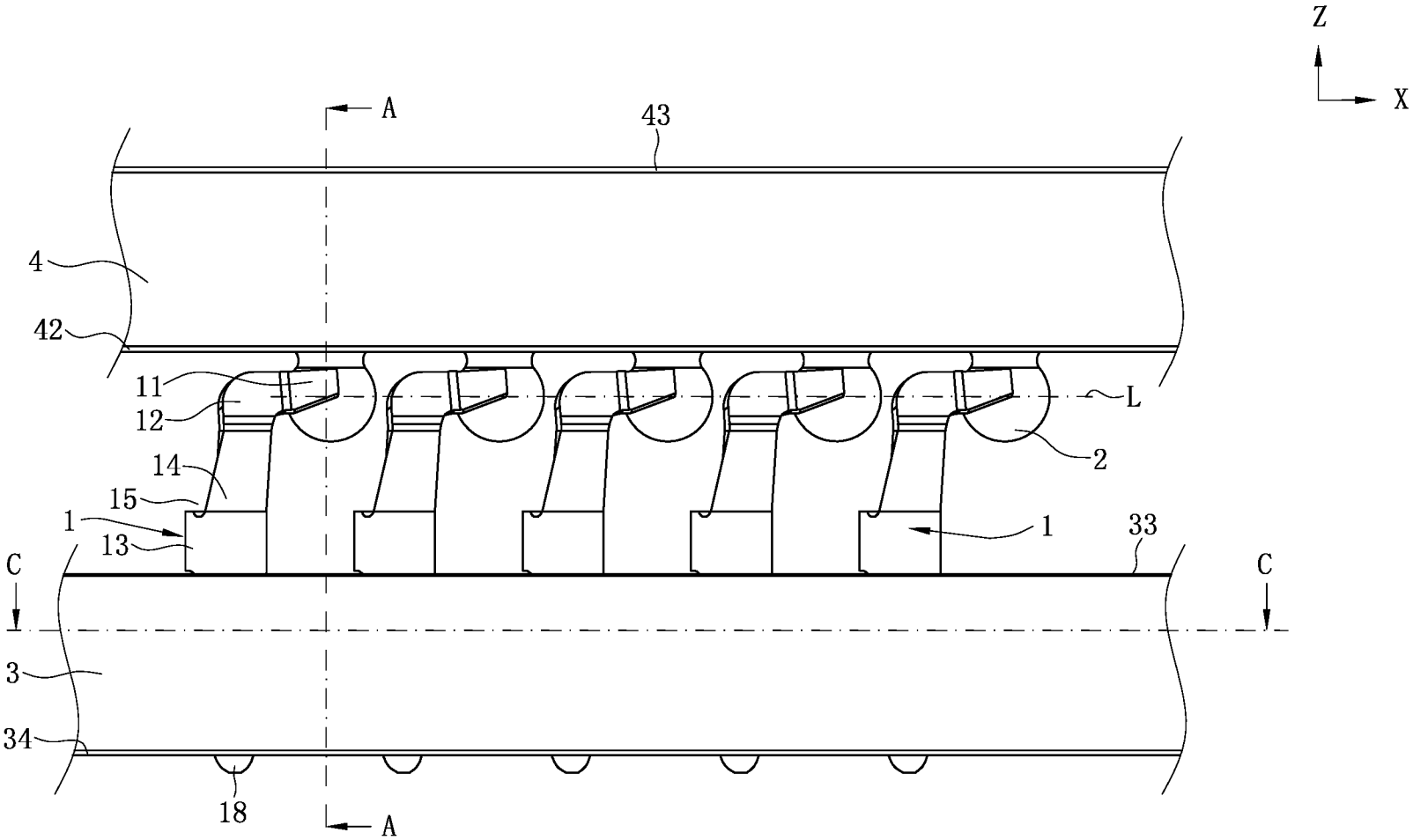
FIG. 3 is a horizontal observational view of FIG. 1.
Figure 4:
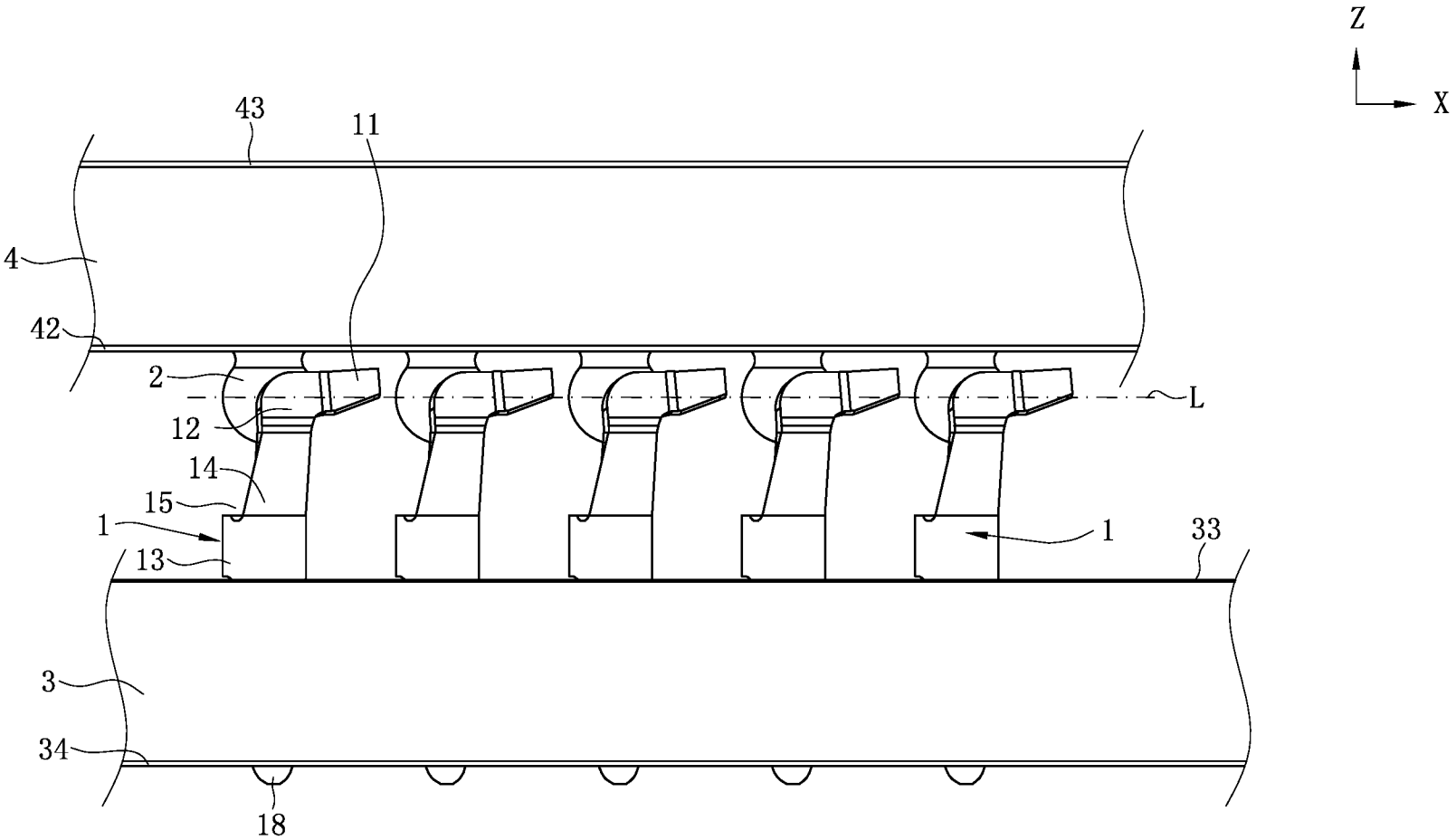
FIG. 4 is a perspective view of the electrical connector assembly according to certain embodiments of the present invention when an insertion portion is inserted downward between two guide portions and has not moved between two of the clamping portions.
Figure 6:
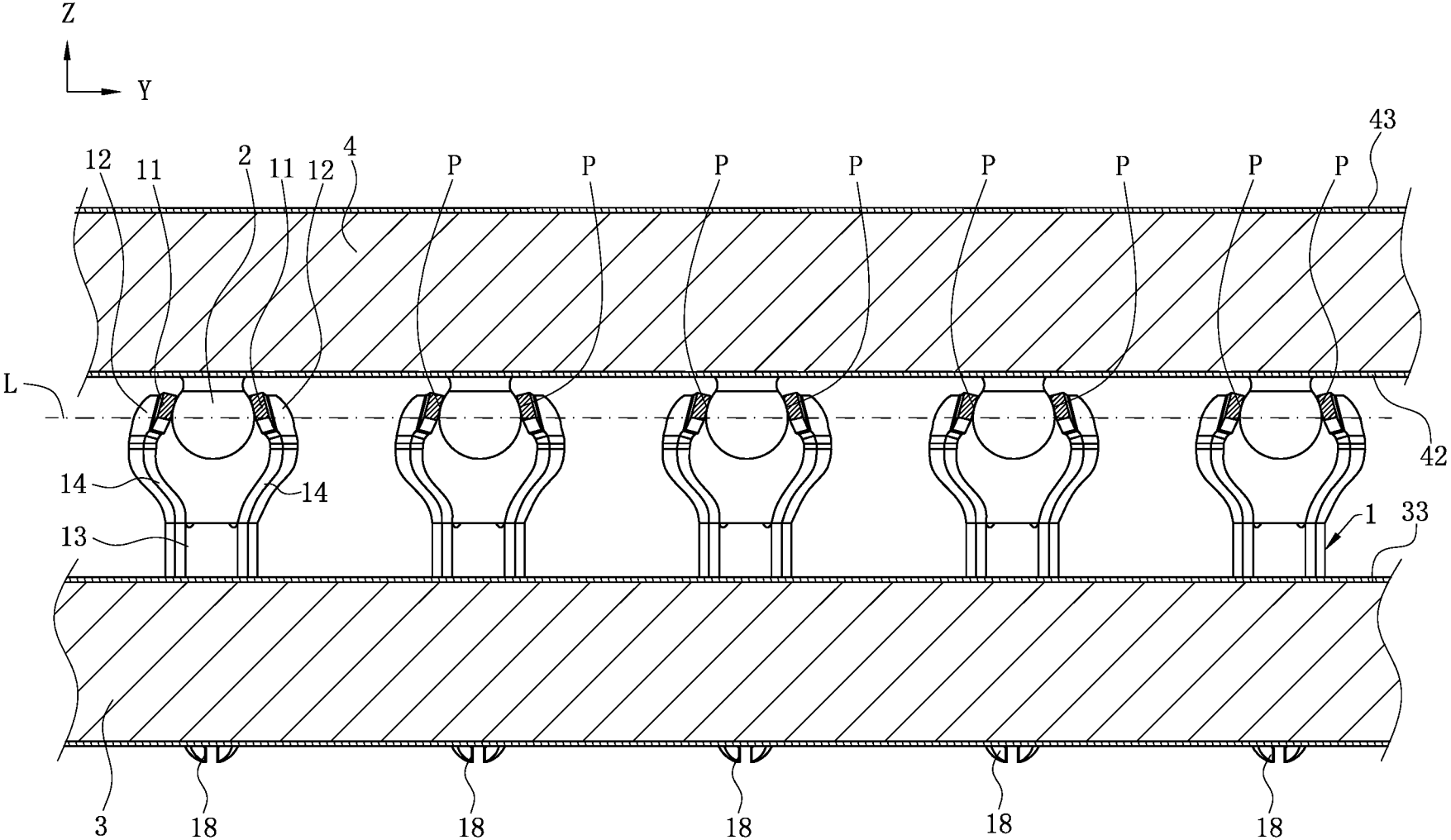
FIG. 6 is a sectional view of FIG. 5 along the A-A direction.
Figure 9:
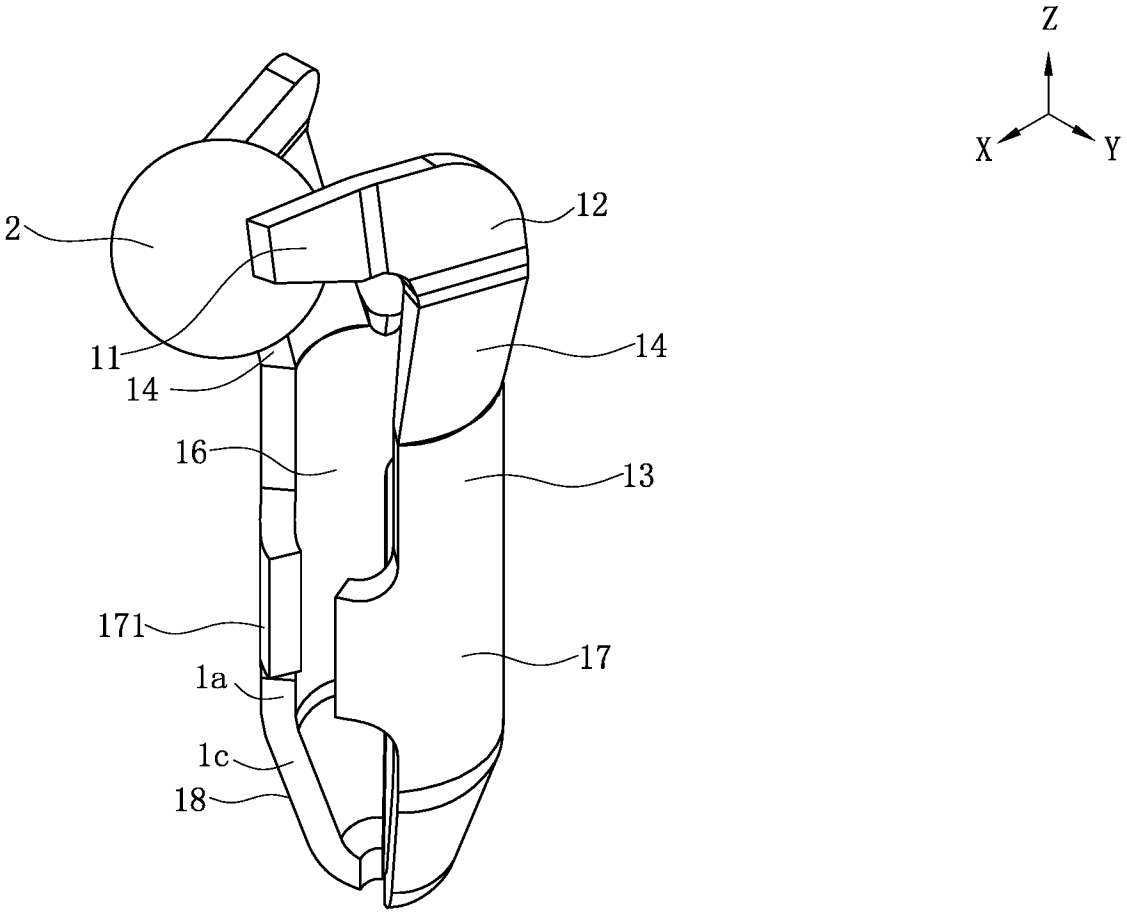
FIG. 9 is a perspective view of a terminal clamping a corresponding insertion portion according to certain embodiments of the present invention.
Figure 10:
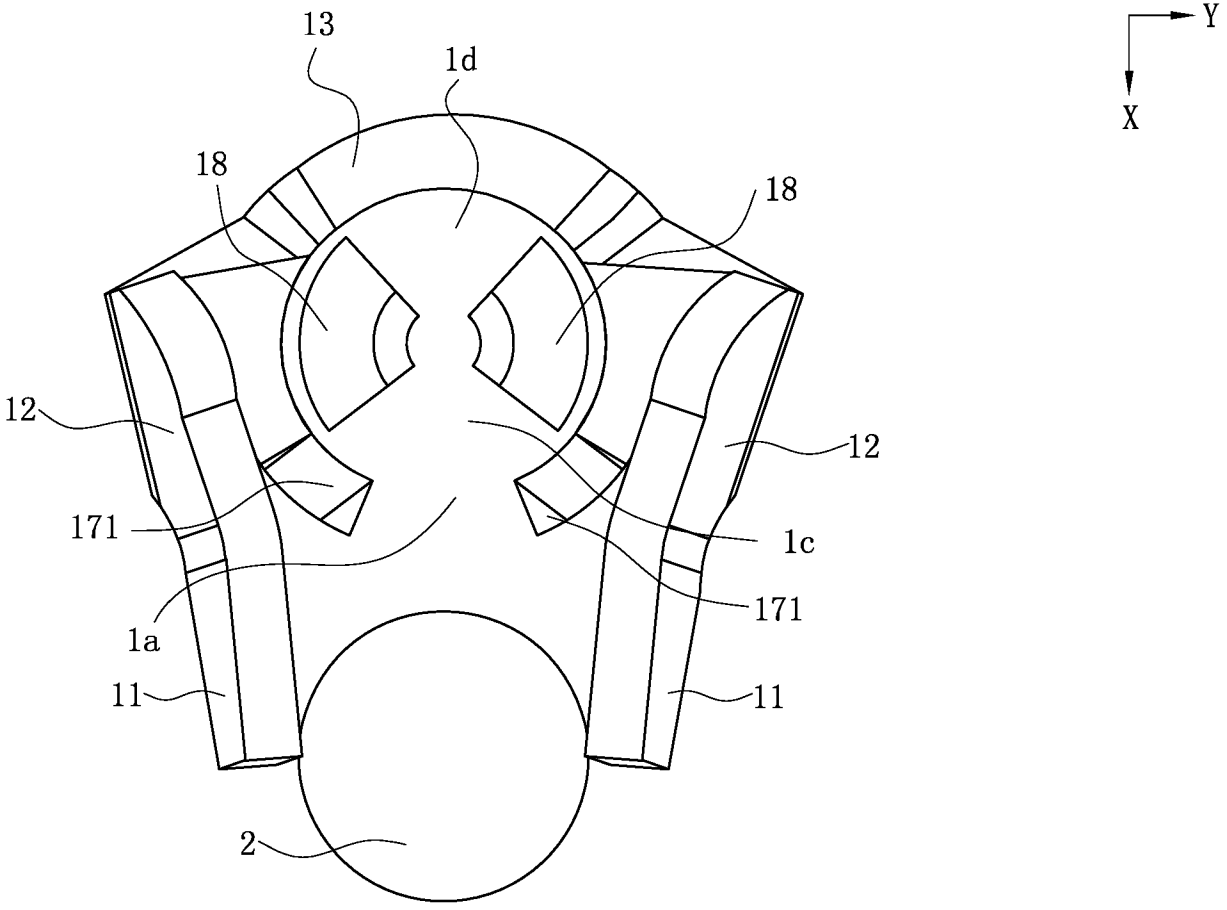
FIG. 10 is a top view of FIG. 9.
Figure 11:
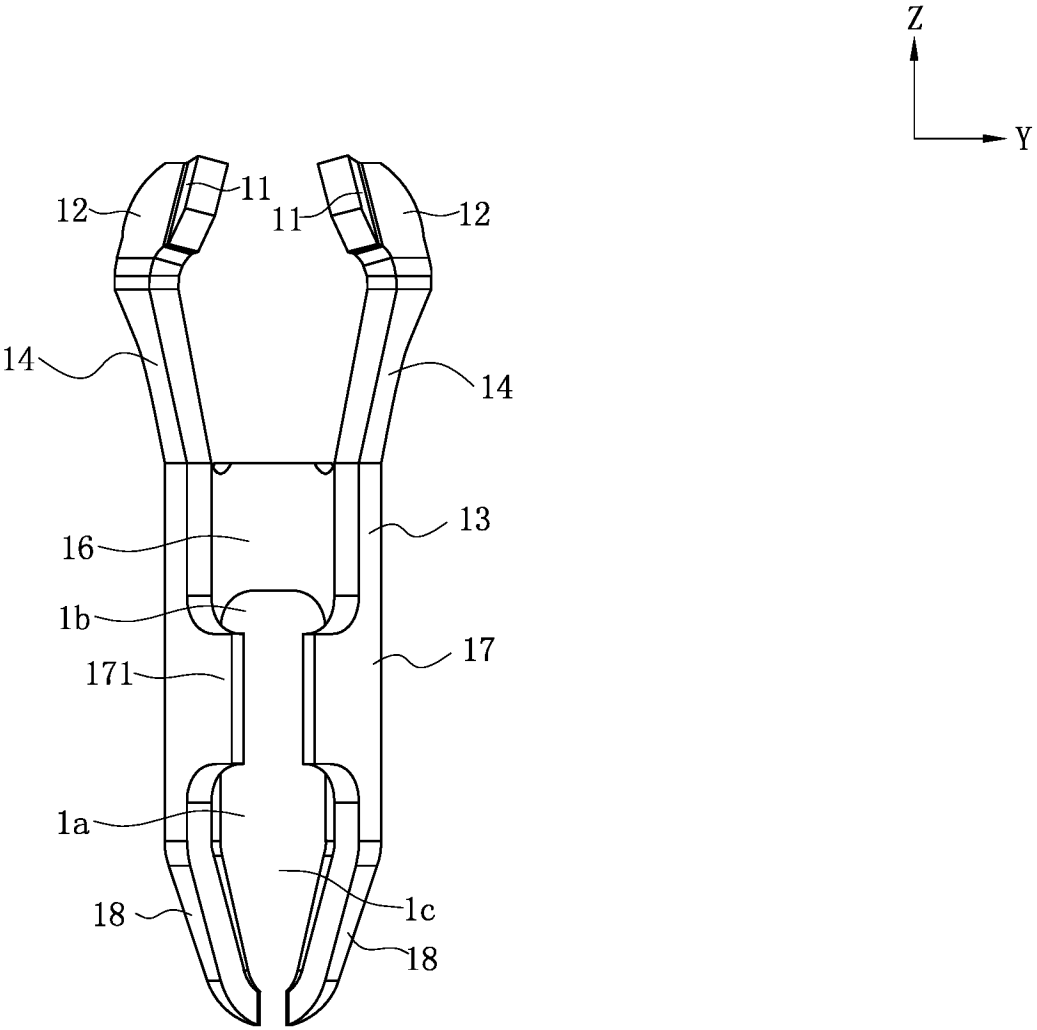
FIG. 11 is a main view of a terminal according to certain embodiments of the present invention.
Figure 12:
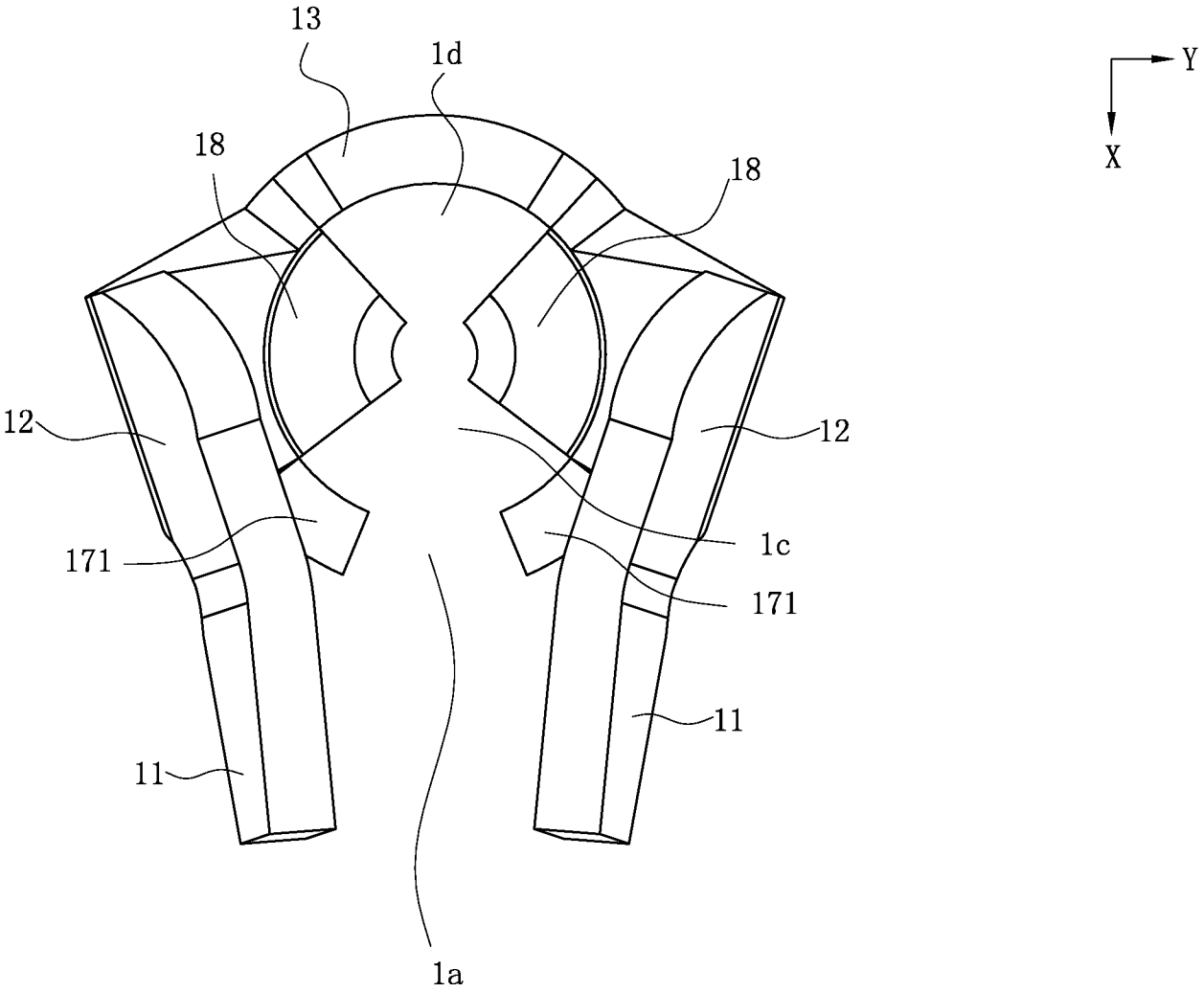
FIG. 12 is a top view of FIG. 11.
Figure 13:
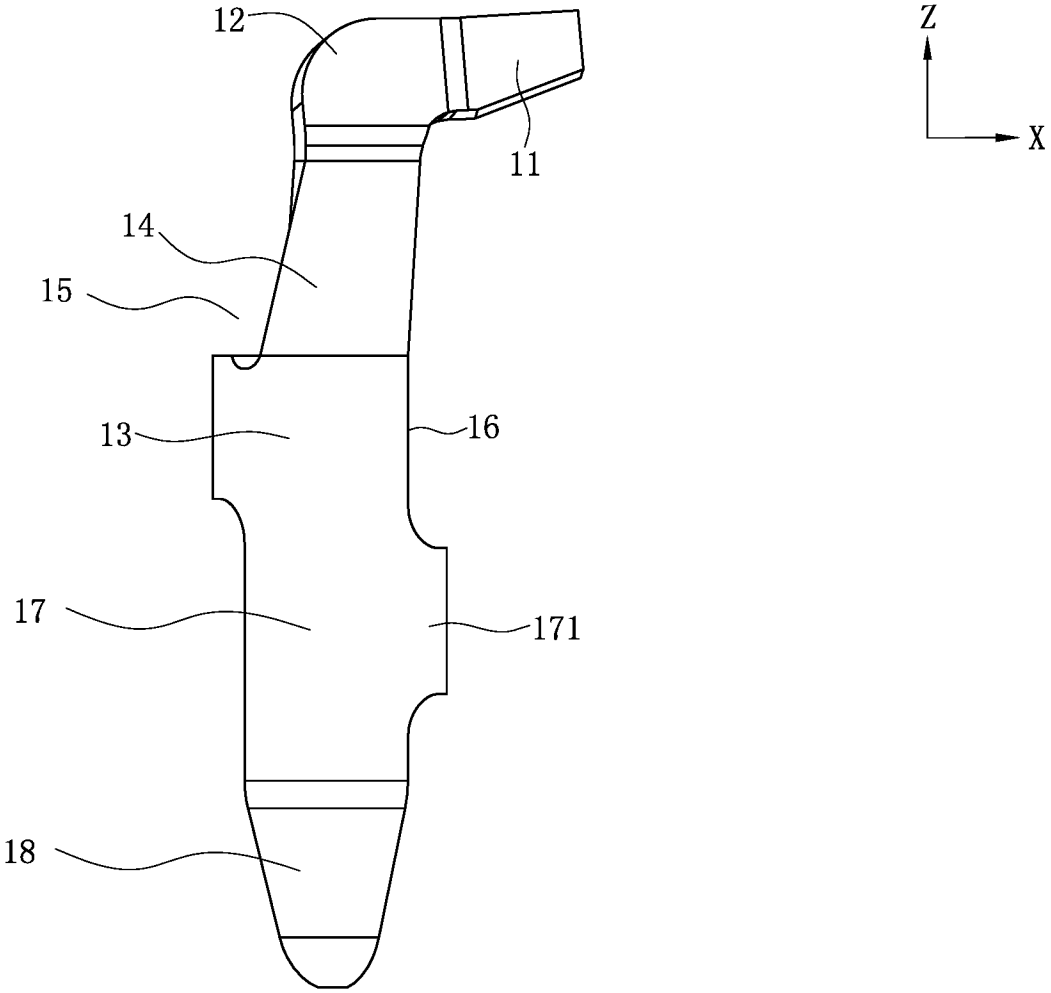
FIG. 13 is a left view of FIG. 11.

As shown in FIG. 9, FIG. 10, and FIG. 13, each terminal 1 has a base 13, which is ring-shaped, and a notch 16 is formed in a front side of the base 13. Two connecting portions 14 extend upward from the base 13. The terminal 1 further has two guide portions 12 and two clamping portions 11. The guide portions 12 are connected to the connecting portions 14, and the clamping portions 11 are formed by extending forward from the guide portions 12. The two clamping portions 11 are configured to clamp a corresponding insertion portion 2. A distance between the two guide portions 12 is greater than a distance between the two clamping portions 11, such that the distance between the two guide portions 12 is greater than a diameter of the insertion portion 2, thereby facilitating the insertion portion 2 to insert downward between the two guide portions 12 with zero insertion force, and then the guide portions 12 guide the insertion portion 2 to horizontally move to the clamping portions 11 (as shown in FIG. 4, FIG. 11 and FIG. 12). As shown in FIG. 3 and FIG. 11, along a upward direction from bottom thereof, the connecting portions 14 expand outward (and in other embodiments, only a portion of the connecting portions 14 may expand outward), and the guide portions 12 incline inward. That is, a distance between the two connecting portions 14 gradually increases upward from bottom thereof, and a distance between the two guide portions 12 gradually decreases upward from bottom thereof, such that the distance between the two clamping portions 11 gradually decreases upward from bottom thereof, and as shown in FIG. 3 and FIG. 6, a position P where the clamping portions 11 clamp the insertion portion 2 is higher than a virtual horizontal center line L of the insertion portion 2. When the insertion portion 2 is clamped by the clamping portions 11, if the position P where the clamping portions 11 clamp the insertion portion 2 is lower than the virtual horizontal center line L of the insertion portion 2, the insertion portion 2 is pushed by an upward pushing force of the clamping portions 11, thereby causing the chip module 500 to move upward. Therefore, in this embodiment, the position P where the clamping portions 11 clamp the insertion portion 2 is higher than the virtual horizontal center line L of the insertion portion 2, such that the clamping portions 11 form a downward pressure to the insertion portion 2, thereby avoiding upward movement of the chip module 500 due to an upward pushing force applied to the insertion portion 2. An accommodating space 15 is provided right above the base 13, and the accommodating space 15 is located behind the guide portions 12. As shown in FIG. 3, when the insertion portion 2 is clamped by the clamping portions 11, a portion of the insertion portion 2 lower than the top ends of the clamping portions 11 protrudes forward from the clamping portions 11 and is accommodated in the accommodating space 15 of an adjacent terminal 1. That is, the portion of the insertion portion 2 lower than the top ends of the clamping portions 11 is located right above the base 13.

As shown in FIG. 7, FIG. 8 and FIG. 9, the base 13 is located outside the corresponding accommodating hole 31, and two fixing portions 17 extend downward from the base 13. (In another embodiment, there may be only one fixing portion 17.) The front ends of the clamping portions 11 pass forward beyond the fixing portions 17. As shown in FIG. 7, the fixing portions 17 and a corresponding accommodating hole 31 are in interference fit to fix the terminal 1 to the corresponding accommodating hole 31. As shown in FIG. 8, the surfaces of the fixing portions 17 are arc surfaces matching the inner wall of the corresponding accommodating hole 31, such that the fixing portions 17 and the inner wall of the accommodating hole 31 have a larger contact surface area, and the terminal 1 is more firmly fixed to the substrate 3. A first through slot 1*a* is formed between the front sides of the two fixing portions 17, and a second through slot 1*b* is formed between the rear sides of the two fixing portions 17. A protruding portion 171 protrudes from the front side of each of the fixing portions 17 toward the first through slot 1*a*, and the two protruding portions 171 of each of the terminals 1 extend toward each other.

As shown in FIG. 7, FIG. 8 and FIG. 9, each terminal 1 further has two leading portions 18 provided separately (in other embodiments, thereby may be only one leading portion 18). The leading portions 18 extend obliquely downward from the fixing portions 17 to guide the terminal 1 to be inserted into the corresponding accommodating hole 31. A portion of each leading portion 18 is located in the corresponding accommodating hole 31, and another portion of each leading portion 18 protrudes from the corresponding accommodating hole 31 to be soldered to the main circuit board 800. A first opening 1*c* is formed between the front sides of the two leading portions 18, and a second opening 1*d* is formed between the rear sides of the two leading portions 18. The first through slot 1*a*, the second through slot 1*b*, the first opening 1*c*, and the second opening 1*d* may reduce a cross-sectional area of the terminal 1, increase a characteristic impedance, and improve a high frequency.

Figure 5:
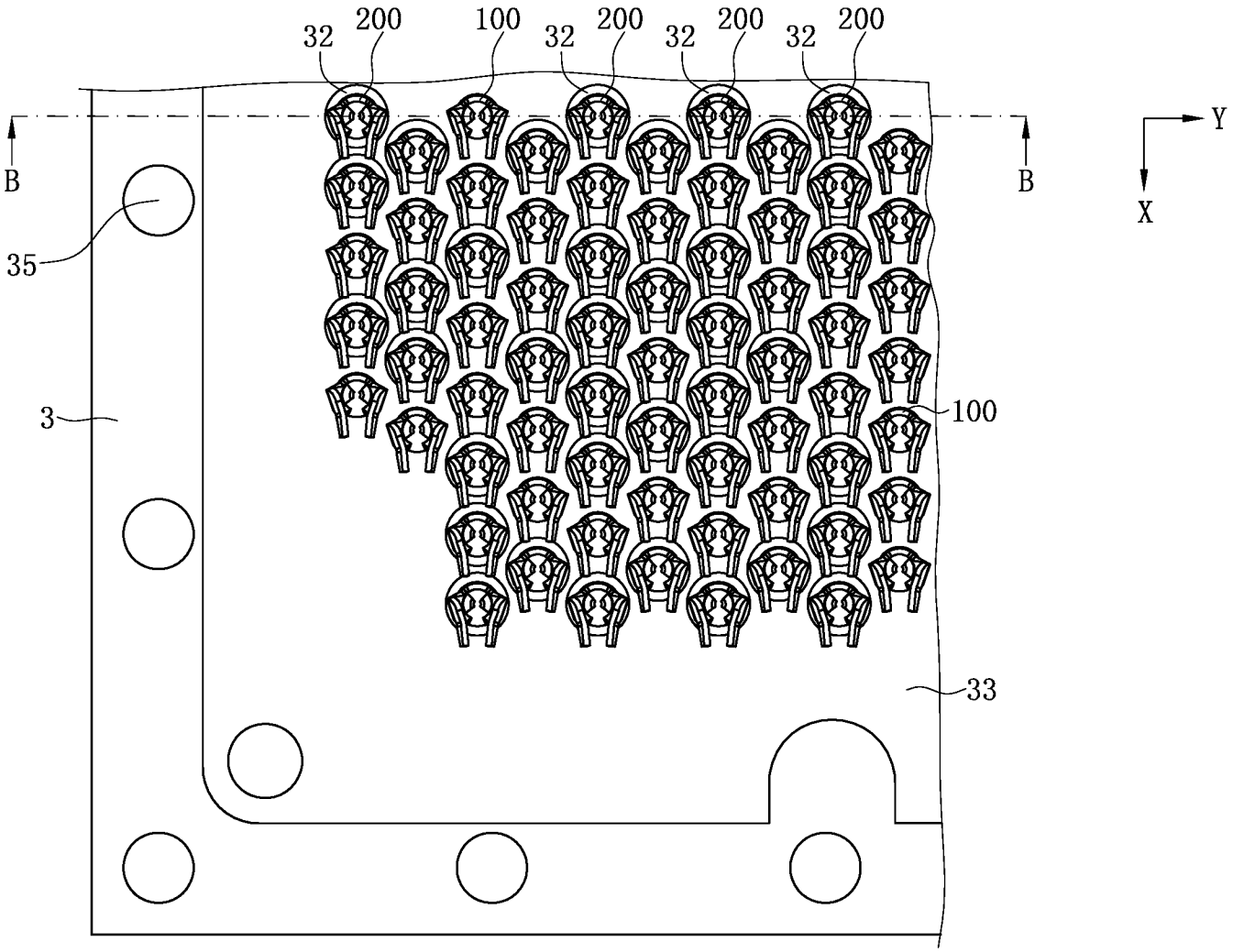
FIG. 5 is a top view of an electrical connector according to certain embodiments of the present invention.
Figure 15:
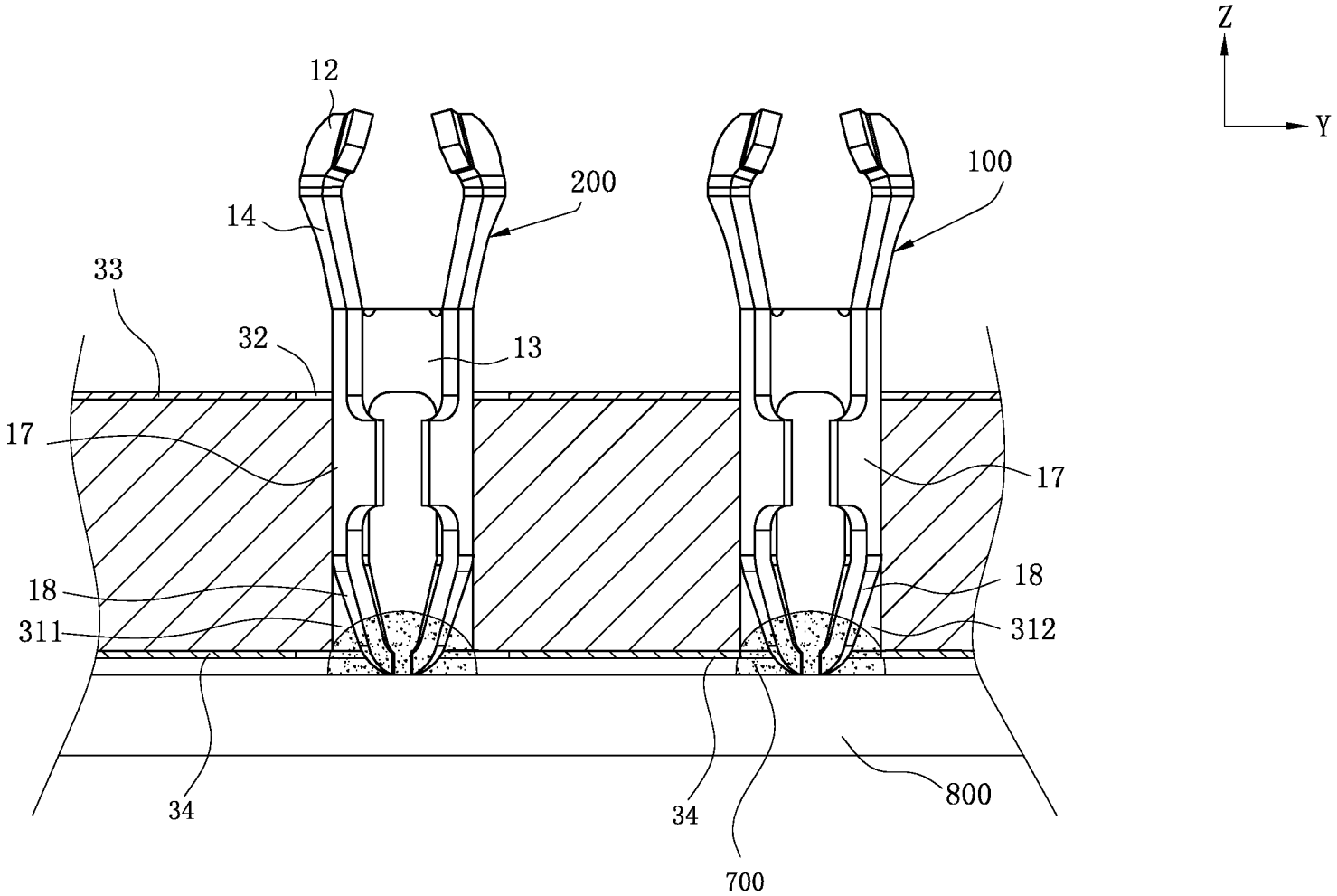
FIG. 15 is a schematic view of terminals being soldered to a main circuit board according to certain embodiments of the present invention.

As shown in FIG. 5 and FIG. 7, the terminals 1 includes a plurality of signal terminals 200 correspondingly accommodated in the first accommodating holes 311 and a plurality of ground terminals 100 correspondingly accommodated in the second accommodating holes 312. The signal terminals 200 are not conductively connected with the third shielding layer 33 and the fourth shielding layer 34. Because the third shielding layer 33 covers the upper edges of the second accommodating holes 312, the fixing portions 17 of the ground terminals 100 are closely attached to upper edges of the correspondingly second accommodating holes 312, such that the ground terminals 100 and the third shielding layer 33 are in contact and are electrically connected. As shown in FIG. 15, the leading portions 18 of the ground terminals 100 are partially located in the correspondingly second accommodating holes 312, such that there are intervals between the leading portions 18 and lower edges of the second accommodating holes 312. When the leading portions 18 are soldered to the main circuit board 800 by solders 700, each solder 700 is filled in the intervals between the leading portions 18 of the ground terminals 100 and the fourth shielding layer 34, such that the solders 700 are connected to the fourth shielding layer 34 and the leading portions 18, and the fourth shielding layer 34 and the ground terminals 100 are electrically connected.

Figure 14:
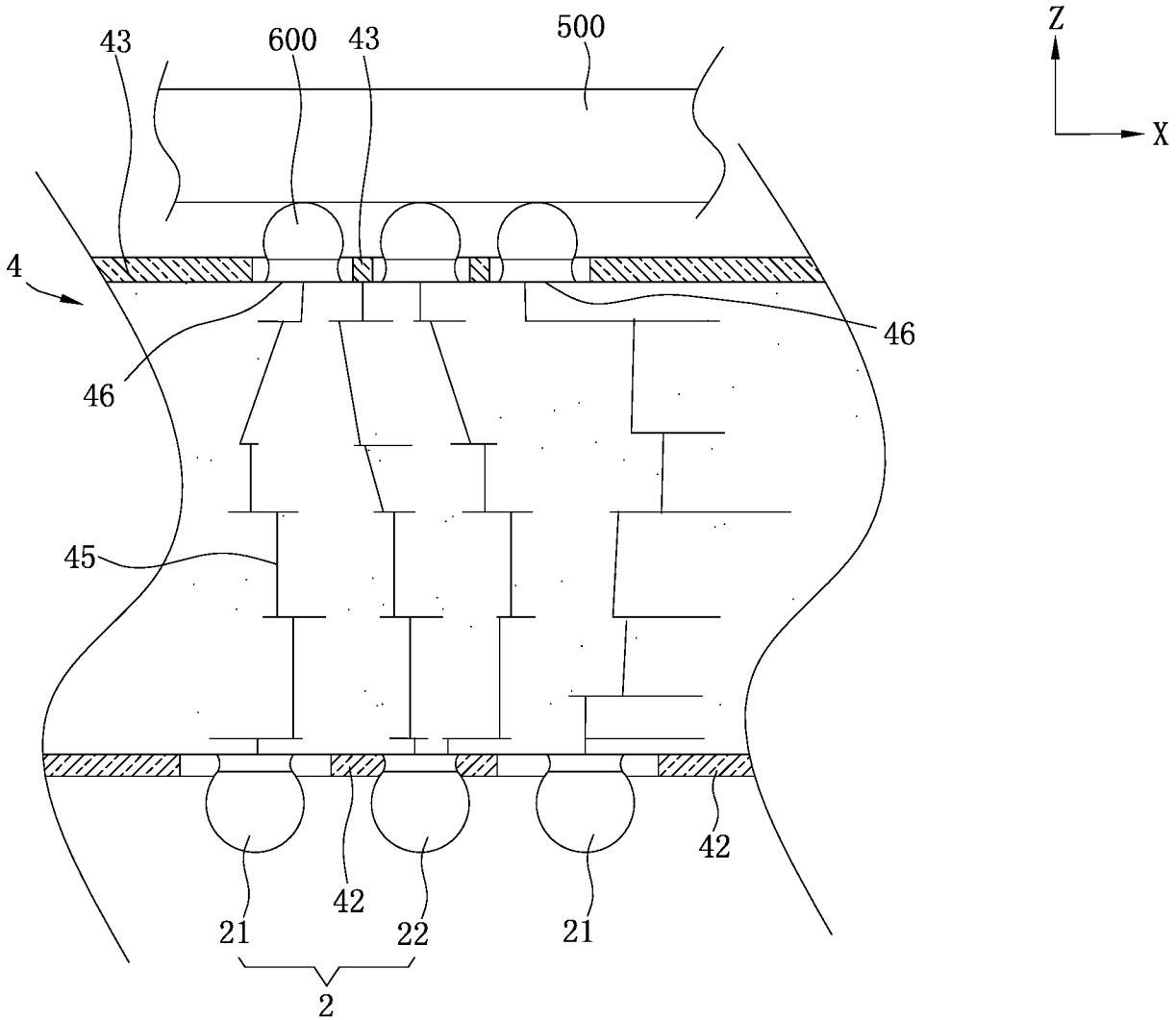
FIG. 14 is a schematic view of a chip module and a support plate being connected according to certain embodiments of the present invention.

As shown in FIG. 1, FIG. 2, and FIG. 14, the support plate 4 is made of a printed circuit board, and specifically can be FR4. There are multiple layers of printed circuits 45 between an upper surface and a lower surface of the support plate 4. A front side surface of the support plate 4 is provided with a stopped portion 41, and a foolproof groove 44 is concavely formed inward from the front side surface of the support plate 4. The lower surface of the support plate 4 has a first shielding layer 42, and the upper surface of the support plate 4 has a second shielding layer 43. As shown in FIG. 1 and FIG. 3, the top portions of the insertion portions 2 are soldered upward to the lower surface of the support plate 4. The insertion portions 2 are made of copper, which may be pure copper or a copper alloy, and is a copper alloy in this embodiment. Specifically, the copper alloy includes 98% of brass and 2% of tin in weight. In addition, surfaces of insertion portions 2 are plated with oxidation resistance coatings, and a material of the coatings is gold. The insertion portions 2 include a plurality of first insertion portions 21 to be clamped by the signal terminals 200 and a plurality of second insertion portions 22 to be clamped by the ground terminals 100. The first shielding layer 42 extends to the second insertion portions 22, such that the first shielding layer 42 and the second insertion portions 22 are conductively connected, and the second insertion portions 22 are connected in series. There are intervals between the first shielding layer 42 and the first insertion portions 21, such that first shielding layer 42 and the first insertion portions 21 are not conductively connected. However, the second shielding layer 43 and the printed circuits 45 are connected, and the printed circuits 45 and the second insertion portions 22 are connected, such that the second shielding layer 43 and the second insertion portions 22 are electrically connected. As shown in FIG. 14, the upper surface of the support plate 4 further has a plurality of soldering regions 46, and the chip module 500 is provided with a plurality of conductors 600 soldered to the soldering regions 46. There are intervals between the conductors 600 and the second shielding layer 43, such that the conductors 600 and the second shielding layer 43 are not conductively connected. The conductors 600 are electrically connected with the insertion portions 2 by multiple layers of the printed circuits 45, and a distance between two adjacent insertion portions 2 is greater than a distance between two adjacent conductors 600, such that there is sufficient space to provide the terminals 1 with a quantity same as a quantity of the conductors 600.

As shown in FIG. 1 and FIG. 2, a blocking frame 5 extends downward to form a plurality of fixing posts 53, corresponding inserted downward into the fixing holes 35 to fix the blocking frame 5 to the substrate 3. The blocking frame 5 has a stopping portion 51 located in front of the stopped portion 41, and has a foolproof portion 52. When the support plate 4 is mounted downward to the electrical connector 300, the foolproof portion 52 is accommodated in the foolproof groove 44 to avoid inverse mounting. The stopping portion 51 overlaps with the stopped portion 41 along the front-rear direction. When each insertion portion 2 moves horizontally to the clamping portions 11, the stopping portion 51 stops the stopped portion 41 forward along a horizontal movement direction of the insertion portion 2.

To sum up, the electrical connector 300 and the electrical connector assembly according to certain embodiments of the present invention have the following beneficial effects:

(1) The distance between two clamping portions 11 of each terminal 1 gradually decreases upward from bottom thereof, and the position where the clamping portions 11 clamp the insertion portion 2 is higher than the virtual horizontal center line L of the insertion portion 2, such that the clamping portions 11 form a downward pressure on the insertion portion 2, thereby avoiding the upward movement of the chip module 500 due to an upward pushing force applied to the insertion portion 2.

(2) Each insertion portion 2 is ball-shaped, so the insertion portion 2 has a smaller length and a greater width in the vertical direction, and the insertion portion 2 has sufficient strength to resist against impact of external force, such that the insertion portion 2 is not easily deformed, thereby ensuring good contact between the terminal 1 and the corresponding insertion portion 2. In addition, each insertion portion 2 has a smaller length in the vertical direction, so the lower end of the insertion portion 2 is near a position P where the insertion portion 2 is clamped by the clamping portions 11, thus alleviating an open stub effect may be alleviated, and thereby improving a high frequency. Further, each insertion portion 2 is made of copper, so the insertion portion 2 has a high melting point, allowing the insertion portion 2 to sustain a high temperature when the chip module 500 operates without deviating from the clamping portions 11 due to creeps and impacting the stability of the electrical connection between the chip module 500 and the electrical connector 300. In addition, the hardness of copper is good, so an antioxidation coating layer plated on the surface of copper is not easily damaged due to scrapes of the clamping portions 11.

(3) A portion of the insertion portion 2 lower than the top ends of the guide portions 12 protrudes forward from the clamping portions 11 and is accommodated in the accommodating space 15 of the adjacent terminal 1. That is, the portion of the insertion portion 2 lower than the top ends of the clamping portions 11 is located right above the base 13 of the adjacent terminal 1, such that a distance between the two adjacent terminals 1 in the front-rear direction is shortened, and the arrangement of the terminals 1 may be denser.

(4) The inner walls of the accommodating holes 31 are insulating, such that electrical conduction of the third shielding layer 33 and the fourth shielding layer 34 is performed without passing through the inner walls of the accommodating hole 31, thereby reducing a capacity and improving a high frequency.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a mating component having a plurality of insertion portions, the electrical connector comprising:

a substrate, provided with a plurality of accommodating holes running through the substrate vertically; and a plurality of terminals, correspondingly accommodated in the accommodating holes, wherein each of the terminals has:

a base, two connecting portions formed by extending upward from the base, two guide portions and two clamping portions, a gap between the two guide portions is greater than a gap between the two clamping portions, the guide portions are respectively connected to the connecting portions, the clamping portions are respectively formed by extending forward from the guide portions, the two clamping portions are configured to clamp a corresponding insertion portion of the insertion portions, wherein after the corresponding insertion portion is inserted downward between the two guide portions, the guide portions guide the corresponding insertion portion to move forward to the clamping portions, a top end of the base is lower than top ends of the clamping portions, an accommodating space is formed right above the base and located behind the guide portions, a height of the accommodating space is between the top ends of the clamping portions and the top end of the base, and when the corresponding insertion portion is jointly clamped by the two clamping portions, a portion of the corresponding insertion portion lower than the top ends of the clamping portions partially protrudes forward from the clamping portions and is accommodated in the accommodating space of an adjacent front terminal.

2. The electrical connector according to claim 1, wherein the substrate is a circuit board, the base extends downward to form at least one fixing portion fixed to the accommodating hole, at least one leading portion is formed by extending obliquely downward from the fixing portion and protrudes out of the accommodating hole to be soldered to a main circuit board, the base is located outside the substrate, and a front end of each of the clamping portions passes forward beyond the fixing portion.

3. The electrical connector according to claim 2, wherein two fixing portions are provided, a first through slot is formed between front sides of the two fixing portions, and a second through slot is formed between rear sides of the two fixing portions.

4. The electrical connector according to claim 2, wherein two leading portions are provided separately, a first opening is formed between front sides of the two leading portions, and a second opening is formed between rear sides of the two leading portions.

5. The electrical connector according to claim 1, wherein the terminals further comprise a plurality of ground terminals, a lower surface of the substrate has a shielding layer, an inner wall of each of the accommodating holes is insulating, each of the ground terminals is soldered to a main circuit board by a solder, and the solder connects each of the ground terminals and the shielding layer.

6. The electrical connector according to claim 1, wherein each of the insertion portions is ball-shaped, a distance between the two clamping portions of each of the terminals gradually decreases upward from a bottom thereof, and a position where the two clamping portions clamp the corresponding insertion portion is higher than a virtual horizontal center line of the corresponding insertion portion.

7. An electrical connector assembly, comprising:

a mating component, comprising a support plate and a plurality of insertion portions provided on the support plate and protruding downward out of the support plate; and an electrical connector, configured for the insertion portions to insert downward therein, wherein the electrical connector comprises:

a substrate, provided with a plurality of accommodating holes running through the substrate vertically; and a plurality of terminals, accommodated in the accommodating holes, wherein each of the terminals has a base and two clamping portions configured to clamp a corresponding insertion portion of the insertion portions, the two clamping portions are located in front of the base, a top end of the base is lower than top ends of the two clamping portions, and when the corresponding insertion portion is jointly clamped by the two clamping portions, a portion of the corresponding insertion portion lower than the top ends of the clamping portions is located right above the base of an adjacent terminal.

8. The electrical connector assembly according to claim 7, wherein two connecting portions extend upward from the base, two guide portions are respectively formed by extending backward from the two clamping portions to guide the insertion portions to move forward, a distance between the two clamping portions is less than a distance between the two guide portions, the guide portions are connected to the connecting portions, and a front end of each of the clamping portions passes forward beyond the connecting portions.

9. The electrical connector assembly according to claim 8, wherein each of the insertion portions is ball-shaped and is made of copper.

10. The electrical connector assembly according to claim 9, wherein the distance between two clamping portions of each of the terminals gradually decreases upward from a bottom thereof, and a position where the two clamping portions clamp the corresponding insertion portion is higher than a virtual horizontal center line of the corresponding insertion portion.

11. The electrical connector assembly according to claim 7, wherein an upper surface of the support plate has a plurality of soldering regions to be correspondingly soldered with a plurality of conductors of a chip module, and a distance between two adjacent ones of the insertion portions is greater than a distance between two adjacent ones of the conductors.

12. The electrical connector assembly according to claim 7, wherein the substrate is a circuit board, the base extends downward to form at least one fixing portion fixed to the accommodating hole, at least one leading portion is formed by extending obliquely downward from the fixing portion and protrudes out of the accommodating hole to be soldered to a main circuit board, the base is located outside the substrate, and a front end of each of the clamping portions passes forward beyond the fixing portion.

13. The electrical connector assembly according to claim 12, wherein two fixing portions are provided, a first opening is formed between front sides of the two fixing portions, and a second opening is formed between rear sides of the two fixing portions.

14. The electrical connector assembly according to claim 12, wherein two leading portions are provided separately, a first opening is formed between front sides of the two leading portions, and a second opening is formed between rear sides of the two leading portions.

15. The electrical connector assembly according to claim 7, wherein the terminals further comprise a plurality of ground terminals, each of an upper surface of the substrate and a lower surface of the support plate respectively has a shielding layer, and each of the ground terminals is electrically connected to the shielding layers.

16. The electrical connector assembly according to claim 7, wherein the support plate is provided with a stopped portion, a stopping portion is located in front of the stopped portion, and the stopping portion stops the stopped portion forward.

* * * * *